US007291252B2

(12) United States Patent
Li et al.

(10) Patent No.: US 7,291,252 B2
(45) Date of Patent: Nov. 6, 2007

(54) ELECTROCOATING CHROME-PLATED STEEL

(75) Inventors: Jian X. Li, Murrysville, PA (US); Daniel E. Bullard, Valporaiso, IN (US); Chyang J. Wu, Monroeville, PA (US)

(73) Assignee: United States Steel Corporation, Pittsburgh, PA (US)

( * ) Notice: Subject to any disclaimer, the term of this patent is extended or adjusted under 35 U.S.C. 154(b) by 562 days.

(21) Appl. No.: 10/303,529

(22) Filed: Nov. 25, 2002

(65) Prior Publication Data

US 2003/0111350 A1 Jun. 19, 2003

Related U.S. Application Data

(60) Provisional application No. 60/339,005, filed on Dec. 7, 2001.

(51) Int. Cl.
*C25D 13/12* (2006.01)

(52) U.S. Cl. ..... 204/486; 204/487; 204/500

(58) Field of Classification Search ..... 204/486, 204/487, 500

See application file for complete search history.

(56) References Cited

U.S. PATENT DOCUMENTS 3,113,845 A * 12/1963 Uchida et al. ..... 428/626
3,558,460 A 1/1971 Uchida et al.
3,816,082 A 6/1974 Austin et al.
3,833,483 A * 9/1974 Umezono et al. ..... 205/142
3,846,356 A 11/1974 Hou et al.
3,864,230 A * 2/1975 Springer et al. ..... 204/486
3,884,856 A 5/1975 Motier et al.
3,898,145 A 8/1975 Davis et al.
3,928,157 A 12/1975 Suematsu et al.
3,939,110 A 2/1976 Colberg et al.
4,057,523 A 11/1977 Blank
4,136,070 A 1/1979 Hazan
4,303,488 A 12/1981 Seiler et al.
4,689,131 A 8/1987 Roue et al.
4,915,797 A * 4/1990 Vigezzi et al. ..... 205/138
4,933,056 A 6/1990 Corrigan et al.
5,068,013 A 11/1991 Bernards et al.
5,073,403 A * 12/1991 Kagechika et al. ..... 427/528
5,202,383 A 4/1993 Moriarity et al.
5,260,354 A 11/1993 Kaylo et al.
5,314,594 A 5/1994 Chung et al.
5,433,099 A * 7/1995 Katsuhiro et al. ..... 72/347
5,506,284 A 4/1996 McGee
5,707,505 A * 1/1998 Huss ..... 204/486
6,017,431 A 1/2000 Augustini et al.
6,214,470 B1 4/2001 Tazzia et al.
6,248,225 B1 6/2001 Palaika et al.
6,290,830 B1 9/2001 Kaylo et al.
6,383,643 B1 5/2002 De Jarlais
6,730,203 B2 * 5/2004 Ikenoue et al. ..... 204/488

* cited by examiner

*Primary Examiner*—Kishor Mayekar
(74) *Attorney, Agent, or Firm*—William L. Krayer

(57) ABSTRACT

Steel cabinet parts and other steel objects are electrocoated in a cationic resin-containing bath. The steel objects are chromium-coated, free of phosphate and preferably free of chromium oxide. The products are not significantly subject to filiform corrosion, and the process is economically beneficial because throwpower is more easily controlled than in previous processes.

17 Claims, No Drawings

ELECTROCOATING CHROME-PLATED STEEL

RELATED APPLICATION

This application incorporates and claims the full benefit of Provisional Application No. 60/339,005 filed Dec. 7, 2001.

TECHNICAL FIELD

This invention relates to appliance housings and other shapes which are stamped or otherwise fabricated or formed from steel strip, and particularly to methods of making electrocoated steel appliance housing preforms and other types of preforms including automotive parts. More broadly, the invention comprises a method of depositing a resin-containing coating on a steel object by electrocoating the steel object having a chrome surface in a bath containing a cationic polymer.

BACKGROUND OF THE INVENTION

The manufacture of appliance cabinets and other parts from steel sheet or strip is a capital-intensive, multi-step process. A simplified recitation of the conventional steps would include forming the incipient housing, cabinet or automotive part from the steel strip, cleaning it, rinsing it, applying a phosphate coating, rinsing again, electrocoating, rinsing, and baking. It should be remembered that housings and cabinet parts for laundry washers and dryers, for example, are large and cumbersome to move in and out of the various coating, drying, immersing and baking areas. In addition, conditions in the electrolytic bath must be monitored and/or controlled. Quality control rejections of large parts such as appliance cabinets can be quite expensive.

Filiform corrosion too often appears between the metal and the final coating, forming iron oxides in thread-like lines emanating from an anodic nucleus where oxygen is able to penetrate through the paint or other coating. To guard against filiform corrosion, phosphate treatment, usually in the form of zinc phosphate, is undertaken to place a phosphate coating on it for corrosion control, but is not entirely effective in that the parts are still undesirably subject to a risk of filiform corrosion.

Such a complicated and demanding process, having many steps and numerous conditions to maintain, necessarily provides many opportunities for error and mishap. The industry would benefit from a simple process with as few steps as possible as well as from obtaining a process which significantly reduces the incidence of filiform corrosion.

Containers made from ECCS (electrocoated chrome/chrome oxide strip, sometimes known as tin-free steel), both three-piece fabricated cans and "D&I", or drawn and ironed cans, without phosphate coatings, have been proposed for electrocoating in a resin-containing bath. See Seiler U.S. Pat. No. 4,303,488 and Colberg's U.S. Pat. No. 3,939,110, both describing polycarboxylic resins for use in electrocoating of cans acting as the anode. Cans are typically quite thin-walled; conventionally, they are clear lacquered.

SUMMARY OF THE INVENTION

We have invented a process which obviates the necessity for several steps in the conventional process, and the use of a phosphate treatment in particular. Our invention includes a method of making an appliance cabinet preform comprising (a) providing a desired two-dimensional shape from a steel strip, the steel strip having on it a layer of chromium metal (b) forming the two-dimensional shape into a desired three-dimensional shape which is at least part of an incipient applicance housing, (c) immersing the three-dimensional shape into an electrolytic cell containing a coating bath comprising a cationic polymer (d) holding the three-dimensional shape in the electrolytic cell for a period sufficient to form an adherent coating on the three-dimensional shape, (e) removing the three-dimensional shape from the bath, and (f) baking the three-dimensional shape to cure the adherent coating.

If the steel strip as received at the electrodeposition facility is ECCS—that is, if it has a chromium/chromium oxide coating, the chromium oxide coating may be removed ("stripped") prior to or after the two-dimensional piece is cut from the strip.

Also, our invention includes an appliance housing comprising a piece of steel strip, the piece of steel strip having been formed into a three-dimensional form, and a (preferably crosslinked) cationic polymer deposited from an aqueous electrolytic bath on top of the chromium undercoat (that is, a coating of chromium between the steel and the polymer-containing outer coating). More succinctly, our invention includes a process for coating steel comprising electrocoating electrolytic chromium coated steel, substantially free of phosphate, in a bath comprising a cationic polymer. The electrolytic chromium coated steel need not be in a three-dimensional form, may be of any practical gauge, may be free of the chromium oxide layer typical of ECCS, and may be in a form for uses other than making appliance cabinets, such as automotive, shelving, tubing and architectural panels. A major advantage of our invention is that the substrate steel may be used as received from the manufacturer—that is, it needs no further treatment to be placed in the appropriate cationic resin-containing bath—and the resulting coating has excellent adhesion characteristics.

If, as received at the resin coating facility, the steel strip is more or less conventional ECCS (electrolytic chrome/chrome oxide steel), the oxide in the chrome oxide layer may be substantially removed Removal of the oxide may be accomplished in any practical manner, as by rinsing it in a solution of sodium hydroxide. Preferably, however, the steel as received can be steel strip which has been treated to form the chrome layer but not the additional chrome oxide layer. Clearly, this will save two steps—the addition of the chrome oxide by the supplier and the removal of the chrome oxide, or a substantial portion thereof.

When used herein, we intend for the following terms to have the meanings indicated: "appliance housing" or "appliance cabinet" means the coated metal housing or cabinet, or an appliance such as a washing machine, dryer, dishwasher, or other similar appliance; "preform" means a piece of steel strip which has been cut and bent, folded, fabricated, crimped, stamped, drawn, molded, or otherwise conformed to a shape useful as at least a part of an incipient appliance housing or cabinet, including doors, fronts, back panels, toe panels and brackets, or an end product other than for applicance; "three-dimensional shape," as applied to an appliance housing or cabinet to a preform means the non-flat shape of a piece of steel strip useful as at least a part of an appliance housing or cabinet or a preform. "Cabinet" and "housing" have the same meaning herein.

DETAILED DESCRIPTION OF THE INVENTION

Electrolytic chromium coated steel ("ECCS"), sometimes referred to as tin-free steel ("TFS"), is black plate or low carbon sheet steel processed and thinly electrolytically plated with metallic chromium together with an outside surface of a chromium oxide film. The typical practice for making ECCS is to prepare an electrolyte containing 70 to 120 grams per liter of $CrO_3$ (chromic acid) together with small amounts of sulfate ions (about 0.2-0.8 grams per liter) and fluoride ions (about 1-5 grams per liter). See Allen, U.S. Pat. No. 3,642,587. The steel to be chromium-coated is the cathode. Much lower concentrations of chromic acid can be used according to the method of Ersan Ilgar disclosed in U.S. Pat. No. 6,331,241. In any case, a light coating of both metallic chromium and chromium oxide is normally placed on the steel sheet, almost always in the form of strip run more or less continuously through the electrolytic bath. In our invention, we may use electrolytic chromium coated steel (ECCS) having a coating weight of 2-20 mg/ft$^2$, preferably 5 mg(±1.5 mg)/ft$^2$, and most preferably 5 mg(±0.5 mg)/ft$^2$, of metallic chromium but with chromium oxide completely absent or present in limited amounts up to 2 mg/ft$^2$. The chromium may be applied in any known manner from an electrolytic bath (plating solution). While conventional ECCS may be used, we prefer that the sheet steel have a chromium coat as above described but is substantially free of chromium oxide. Our use of the term "tin-free steel" includes unfinished ECCS, meaning that only the chromium coating is placed on it, not the chromium oxide.

The chromium may be in the form of Cr(VI) or Cr(III), but Cr(III) is preferred, as Cr(VI) is generally criticized for its potential toxicity. The above recited coating weights are determined as trivalent chromium.

The resin-containing coating bath to be used in our invention may be any coating bath including a cationic polymer which may be deposited onto the chrome-coated substrate from an electrolytic bath.

Aqueous electrolytic coating baths useful in our invention—that is, containing cationic polymers which may be deposited onto the chrome-coated substrate from an electrolytic bath—include coating compositions described as useful in electrolytic bath applications in the following US Patents, which are hereby incorporated by reference in their entirety: Bosso et al U.S. Pat. Nos. 4,170,579 and 4,610,769, Corrigan et al U.S. Pat. No. 5,096,556, Moriarity et al U.S. Pat. No. 4,432,850, Roue et al U.S. Pat. No. 4,689,131, Kaylo et al U.S. Pat. Nos. 6,093,298, and 6,033,545, Karabin et al U.S. Pat. No. 6,190,525, McMurdie et al U.S. Pat. No. 6,110,341, Boyd et al U.S. Pat. No. 6,017,432, Augustini et al U.S. Pat. No. 6,017,431, Kaufman et al U.S. Pat. Nos. 5,820,987 and 5,936,012, Scott et al U.S. Pat. No. 5,464,887 and Valko et al U.S. Pat. No. 5,074,979. In our invention, we may use any coating containing a cationic polymer which may be electrodeposited on steel acting as a cathode, including all such compositions described in the above patents. The anode may be a carbon anode or any other anode useful in the art. The compositions are placed in a bath and the incipient appliance cabinet or housing parts, preforms, or other forms of steel as described herein are immersed in it and then subjected to an electric current in any effective manner, preferably the commonly used manner for coating appliance parts and other such workpieces including automotive parts and/or any other parts or partially fabricated forms made from steel. Most preferably the steel preforms or articles are substantially free of chrome oxide. The bath compositions described as useful for cationic electrodeposition in the above incorporated patents may be used with or without the various additives or adjustments to the basic bath formulation which may be the subject of the particular patents, such as a particular curing agent or crater control agent, the blocked isocyanate groups of Valko et al '979 or Boyd et al '432, a flatting agent such as described by Scott et al '887, a bactericide of Augustini '431, the microgels of Corrigan '556, the yttrium of Karabin '525, or organic phosphorous of McMurdie '341. Numerous other optional ingredients as are known in the art may be used in the coating bath.

The cationic polymer may, in some cases, be described as not dissolved, but in suspension in association with anionic moieties such as anionic surfactants; the polymer is generally in an aqueous base. The aqueous base may include pigments, dyes, and preferably a crosslinker for the cationic polymer; total solids will generally range from 10% by weight to 20% by weight but may vary considerably outside of this range.

In the electrodeposition of resins, the deposition rate at a given point on the surface of the cathodic workpiece will vary not only with its distance from the anode but with the shape of the workpiece—that is, whether the current must travel an indirect path through the bath to get to it; in addition, the process may be said to be dynamic in that the rate of deposition at a given point will vary with the insulating effects of the newly laid coating on other portions of the substrate. The ability of a process to coat a relatively inaccessible part of the surface of a workpiece has been the subject of much study. This phenomenon is observed, measured or known as throwpower, throwing power, or similar expressions, and is generally a factor to consider in the evaluation of resin-containing bath compositions. As defined in U.S. Pat. No. 4,933,056, throwpower is the property of the electrodeposition composition to coat out at varying distances from the counter-electrode with substantially the same density of product. Persons skilled in the art have measured throwpower in various ways, almost always in order to judge the acceptability of a coating composition used in an electrolytic bath. See Donald R. Hays and Charles W. White, "Electrodeposition of Paint: Deposition Parameters" Journal of Paint Technology vol. 41, No. 535 pages 461-471, August 1969; Motier et al U.S. Pat. No. 3,884,856; Hou et al U.S. Pat. No. 3,846,356; Davis et al U.S. Pat. No. 3,898,145; Blank U.S. Pat. No. 4,057,523; Corrigan U.S. Pat. No. 4,933,056; Bernards U.S. Pat. No. 5,068,013 (see the data in the tables at the top of column 8, expressing throwpower in terms of the ratio of current at one point to the current at another point); Moriarity et al U.S. Pat. No. 5,202,383, and Chung U.S. Pat. No. 5,314,594. Our invention, using a substantially phosphate-free chromium plated steel, with or without a chromium oxide coating, and using a cationic polymer-containing coating bath, generally not only evinces a throwpower substantially equivalent to that of prior art substrates in equivalent baths, but in some instances, particularly where there is no chromium oxide layer, can show substantial improvement in throwpower. Improvements in throwpower can enhance productivity rates, allow better coating thickness control, and/or provide substantial savings in electric power, depending on how the improvements are used. Since our invention may permit the use of less electric power to achieve a given throwpower ratio, it may be used to achieve more versatile economic as well as technical control over the entire resin electrocoating process. Thus, our invention includes a method of operating an electrolytic coating line wherein a steel object to be coated is placed as a cathode in a bath of coating composition comprising a cationic polymer in an electrolytic cell and subjected to an electric current in the bath for a residence time therein until a coating of a desired thickness on at least a first target area of the surface of the steel object is achieved for drying or curing, comprising (a) utilizing as the steel object an object made of steel having a coating of chromium metal and being substantially free of phosphate (b) determining a range of residence times necessary to achieve the desired coating on the object under a range of power conditions, and (c) employing a selected combination of power and residence time for said object within the bath.

According to Suematsu's U.S. Pat. No. 3,928,157, the adhesion of a coating to a steel substrate having a chrome surface is enhanced if the substrate has an Open Circuit Potential ("OCP") of greater than −420 $mV_{SCE}$, where SCE denotes a saturated calomel electrode and the measurement is taken after 15 seconds in 0.1 citric acid/0.2 M sodium hydrogen phosphate (pH 4.7). The Suematsu patent reports increases in the OCP after longer periods of time up to 48 hours. Suematsu's substrate included a layer of nickel.

For a comparison of our process to Suematsu's observations, chromium oxide was stripped from some samples of conventional ECCS (hereafter called "stripped" samples), and other samples were obtained of tin-free steel having been treated only to plate with chromium and not additionally with chrome oxide (hereafter called "not stripped").

The oxide was stripped from the line trial material in 10M sodium hydroxide at 180° F. for 2 minutes, rinsed in warm tap water, rinsed in distilled water and dried under hot air. Within 5 minutes, an area on the sample was immersed in the prescribed electrolyte while the OCP vs. SCE was recorded. The samples were then exposed to the ambient laboratory environment and the OCP was recorded after 24 hours and 7 days at a different location on the sample. Line trial samples with intact oxides were tested as well. Circulation cell material was produced using a dilute plating chemistry consisting primarily of chromate acid ions, following the methods of Ilgar's U.S. Pat. No. 6,331,241, which minimizes hexavalent chromium concentrations.

Three replicates per condition were tested for the line trial material, while duplicate measurements were made for the circulation cell material. Table 1 shows the OCP values after 15 seconds. In general, no significant change in the OCP was observed for the stripped panels. Immediately after stripping, the OCP was approximately −670 $mV_{SCE}$, then decreased slightly to approximately −680 after 24 hours. After 7 days exposure the OCP was between −660 and −665 $mV_{SCE}$. The OCP of the unstripped TFS sheet was approximately −670, similar to that observed at 24 hours after stripping. The OCP of the circulation cell is similar to those observed for the stripped samples after 24 hours in the atmosphere.

| Sample | OCP($mV_{SCE}$) t = 0 h Post−strip | OCP T = 24 h | OCP T = 7 d | OCP Not stripped | OCP Circ. Cell |
|---|---|---|---|---|---|
| 1 | −670 | −684 | −661 | −672 | −683 |
| 2 | −673 | −681 | −665 | −669 | −687 |
| 3 | −672 | −678 | −664 | −670 | |

Contrary to implications of Suematsu's results, finished painted (electrocoated) steel made by our process has been found to have both excellent detergent resistance and humidity resistance. We prefer that the chrome-coated steel used in our process should have an OCP lower (more negative) than −500 $mV_{SCE}$.

In addition, our invention virtually eliminates filiform corrosion. To demonstrate this, a filiform corrosion test was based on ASTM D 2803, Filiform Corrosion Resistance of Organic Coatings on Metal. Panels used included ECCS panels free of phosphate and having a commercial resin electrocoat. The scribe was made in the middle of the e-coated panel. The panels were placed in the ASTM B 117 salt spray cabinet for 24 hours. The panels were rinsed with D.I. water and then placed in 80 percent relative humidity at 80° F. for 500 hours. All three samples of phosphate-free ECCS evidenced no filiform corrosion at all. In a 1000 hour filiform corrosion test at 80% relative humidity panels coated according to our invention again showed no filiform corrosion.

Thus our invention includes a method of making an appliance cabinet preform comprising (a) providing a steel strip, said steel strip having a chromium coating and being substantially free of phosphate, (b) forming a portion of said steel strip into a desired three-dimensional shape which is at least part of an incipient appliance cabinet preform, (c) immersing said three-dimensional shape as a cathode into an electrolytic cell containing an aqueous coating bath comprising a cationic polymer (d) holding said three-dimensional shape in said electrolytic cell under coating conditions for a residence time sufficient to form an adherent coating on said three-dimensional shape, (e) removing said three-dimensional shape from said bath, and (f) baking said three-dimensional shape including said adherent coating. The three-dimensional shape may be cleaned between steps (e) and (f).

The invention claimed is:

1. Method of making an appliance cabinet preform comprising (a) providing a steel strip, said steel strip having a chromium coating and being substantially free of phosphate, (b) rinsing said steel strip in an alkaline solution, thereby stripping said steel of chromium oxide, (c) forming a portion of said steel strip into a desired three-dimensional shape which is at least part of an incipient appliance cabinet preform, (d) immersing said three-dimensional shape as a cathode into an electrolytic cell containing an aqueous coating bath comprising a cationic polymer (e) holding said three-dimensional shape in said electrolytic cell under coating conditions for a residence time sufficient to form an adherent coating on said three-dimensional shape, (f) removing said three-dimensional shape from said bath, and (g) baking said three-dimensional shape including said adherent coating.

2. Method of claim 1 wherein said chromium coating comprises from 2 to 20 $mg/ft^2$ chromium metal per square foot of surface.

3. Method of claim 1 wherein said three-dimensional shape is cleaned between step (f) and step (g).

4. Method of claim 1 wherein said steel strip has an open cell potential lower than −500 $mV_{SCE}$.

5. Method of claim 1 wherein said electrolytic cell has a carbon anode and is operated with direct current.

6. Method of claim 1 wherein said bath includes a pigment.

7. Method of claim 1 wherein said bath includes a crosslinker.

8. Method of coating tin-free steel, said tin-free steel being electrocoated chrome/chrome oxide steel having a coating of chromium and chromium oxide, said tin-free steel being substantially free of phosphate, comprising rinsing said steel in a solution of sodium hydroxide, whereby said steel has an open cell potential lower than −500 $mV_{SCE}$, and electrocoating said steel as a cathode under a direct current in a bath comprising a cationic polymer.

9. Method of claim 8 wherein said tin-free steel is substantially free of chromium oxide coating after said rinsing.

10. Method of operating an electrolytic coating line wherein a steel object to be coated is placed as a cathode in a bath of coating composition comprising a cationic polymer in an electrolytic cell and subjected to an electric current in said bath for a residence time therein until a coating of a desired thickness on at least a first target area of the surface of said steel object is achieved for drying or curing, comprising (a) utilizing as said steel object a preformed object having a three-dimensional shape, made of steel having a coating of chromium metal and being substantially free of phosphate and substantially free of chromium oxide, (b) determining a range of residence times necessary to achieve said desired coating thickness on said first target area under a range of power conditions, and (c) employing a selected combination of power and residence time for said object within said bath.

11. Method of claim 10 wherein said electric current is applied at a voltage of 110-225 volts.

12. Method of claim 10 wherein said selected combination of power and residence time is employed also to achieve a desired coating thickness on a second target area of the surface of said steel object.

13. Method of claim 10 wherein 5 mg(±1.5 mg)/$ft^2$ of said chromium metal is present on the surface of said steel object.

14. A method of coating a steel object comprising (a) providing a steel object free of phosphate and having a chromium layer substantially free of chromium oxide, said steel having an open cell potential lower than 500 $mV_{SCE}$, (b) placing said steel object in an electrolytic bath including an organic cationic polymer, and (c) electrolytically coating said steel object in said bath with a coating including said cationic polymer.

15. The method of claim 14 wherein said steel object is made of electrolytic chrome/chrome oxide steel which has been treated to remove substantially all the chrome oxide.

16. The method of claim 14 wherein said steel object is steel strip, followed by baking said steel strip having a coating of cationic polymer thereon.

17. The method of claim 16 followed by shaping said steel object into a desired three-dimensional form.

* * * * *